United States Patent [19]

Matsui

[11] Patent Number: 4,610,406

[45] Date of Patent: Sep. 9, 1986

[54] BOBBIN SUPPLYING SYSTEM

[75] Inventor: Isamu Matsui, Kyoto, Japan

[73] Assignee: Murata Kikai Kabushiki Kaisha, Kyoto, Japan

[21] Appl. No.: 645,177

[22] Filed: Aug. 28, 1984

[30] Foreign Application Priority Data

Sep. 2, 1983 [JP] Japan ..... 58-162333

[51] Int. Cl.[4] ..... B65H 67/06

[52] U.S. Cl. ..... 242/35.5 A

[58] Field of Search ..... 242/35.5 A, 35.5 R, 242/35.6 R; 57/268, 270, 266, 274, 276, 281

[56] References Cited

U.S. PATENT DOCUMENTS

| | | | |
|---|---|---|---|
| 3,224,694 | 12/1965 | Oishi | 242/35.5 R |
| 3,358,940 | 12/1967 | Beckwith, Jr. et al. | 242/35.5 R |
| 3,966,141 | 6/1976 | Nishiyama et al. | 242/35.5 A |
| 4,010,907 | 3/1977 | Nishiyama et al. | 242/35.5 A |
| 4,063,635 | 12/1977 | Heckel | 242/35.5 A X |
| 4,181,228 | 1/1980 | Hashimoto et al. | 242/35.5 A X |
| 4,463,909 | 8/1984 | Kiriake et al. | 242/35.5 A |

FOREIGN PATENT DOCUMENTS

| | | | |
|---|---|---|---|
| 3235442 | 4/1983 | Fed. Rep. of Germany | 242/35.5 A |
| 152767 | 9/1983 | Japan | 242/35.5 A |

*Primary Examiner*—Stanley N. Gilreath

*Attorney, Agent, or Firm*—Spensley Horn Jubas & Lubitz

[57] ABSTRACT

A bobbin supplying system for use with an automatic winder. A spinning bobbin is erectly fitted on a transporting medium and is circulated between winding units and a bobbin supplying station. In response to arrival of the transporting medium at the bobbin supplying station, a bobbin demanding signal is produced in order to supply a spinning bobbin to the empty transporting medium.

10 Claims, 6 Drawing Figures

BOBBIN SUPPLYING SYSTEM

BACKGROUND OF THE INVENTION

1. Field of the Invention

The present invention relates to a bobbin supplying system for use with an automatic winder.

2. Prior Art

Generally in supplying spinning bobbins produced on a fine spinning frame to a winder for a subsequent rewinding step, if spinning bobbins are not supplied in accordance with a working capacity of the winder, that is, if they are supplied too much, then they will overflow an area of the winder, and on the contrary if they are supplied in short, then some winding units will be rendered into idling.

Meanwhile, in a winder, various yarns of different yarn counts are wound and a time required for an spinning bobbin is differentiated among various kinds of yarns, and hence if a kind of yarn to be rewound is changed, naturally the number of spinning bobbins to be supplied per a unit time also changes. Accordingly, for example, when an operator goes round the winder to find in a magazine of a winding unit an empty room into which a spinning bobbin or spinning bobbins are to be supplied, a cycle in which the operator goes round must necessarily be changed depending upon the kind of yarns and in accordance with a change of the working capacity of the winder. Also in case of a travelling car which travels along winding units to automatically supply spinning bobbins to bobbin magazines, it presents such a problem that the travelling speed of the travelling car must be changed.

SUMMARY OF THE INVENTION

An object of the present invention is to provide a very rational and reliable bobbin supplying system which is not influenced at all by a change of the working capacity of a winder and so on.

In particular, according to the present invention, transporting media on which spinning bobbins are individually placed for transportation thereof are circulated between winding units and a bobbin supplying station, and in response to arrival of a transporting medium at the bobbin supplying station, a bobbin demanding signal is produced in order to supply a spinning bobbin to the transporting medium.

DETAILED DESCRIPTION OF THE INVENTION

Now, an embodiment of a system of the present invention will be described with reference to the accompanying drawings.

Figure 2:
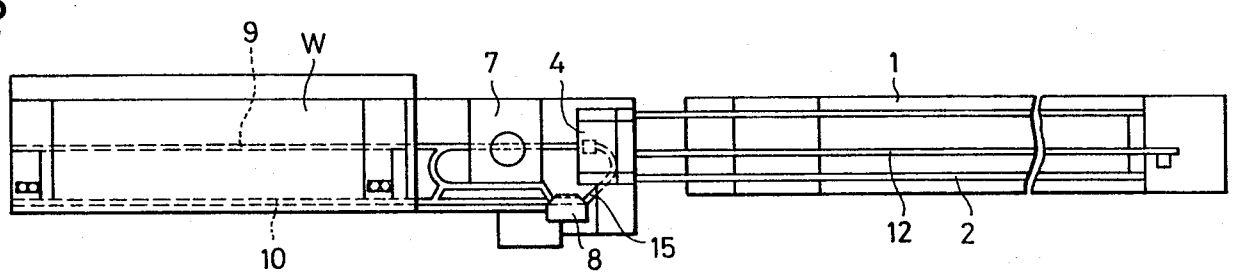
FIG. 2 is a plan view of the system of FIG. 1.
Figure 1:
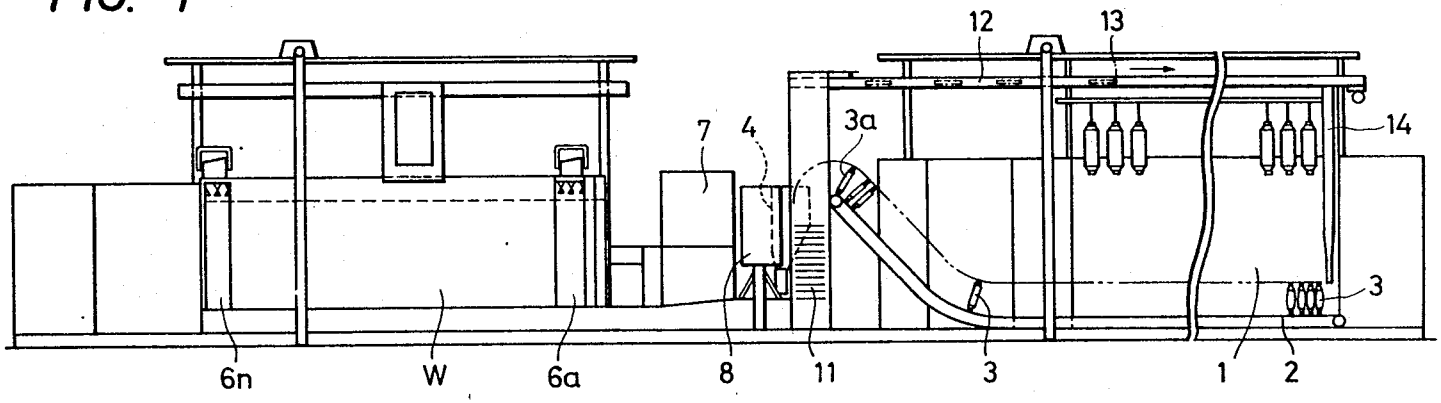
FIG. 1 is a front elevational view, in schematic representation, showing a first embodiment of a system of the present invention.

FIGS. 1 and 2 illustrate a fine spinning winder in which a fine spinning frame and a winder is connected to each other. In particular, a spinning bobbin 3 on which a spinning yarn produced on the fine spinning frame 1 is wound is fitted and supported, for example, on a peg of a transport band 2 and is fed in a longitudinal direction along the fine spinning frame 1 until it is thrown into a bobbin supplying device 4. The spinning bobbin 3 is then fitted erectly on a bobbin transporting medium in a stand-by position below which medium may, for example, be a carrier 5 in FIG. 3, which is being fed on a belt conveyor. Thus, the spinning bobbin 3 is supplied to any of winding units *6a* to *6n* of the winder W. Reference numeral 7 designates a yarn end finding device, and 8 a device for extracting an empty bobbin or a small amount of yarn bobbin.

Supply of bobbins to individual winding units of the winder W are effected such that spinning bobbins are individually supplied to a winding position of each unit from a spinning bobbin transporting conveyor 9 while they are held fitted on respective carriers. An empty bobbin from which a yarn has been completely unwound or a partial-bobbin with a remaining yarn thereon is then fed on an empty bobbin transporting conveyor 10. An empty bobbin and a bobbin with a remaining yarn thereon are separated from each other by the extracting device 8. An empty bobbin is then pulled off its carrier by the extracting device 8 and is fed upwardly by an empty bobbin lifting device 11 whereafter it is fed horizontally by means of a belt conveyor 12 which extends above and in a longitudinal direction of the spinning frame. The empty bobbin 13 thus fed to an end of the spinning frame is then dropped into and stored in a chute 14 until it is supplied and fitted onto an empty peg on the transport band below at a suitable point of time.

Meanwhile, in the winder area, an emptied carrier from which an empty bobbin has been extracted by the bobbin extracting device 8 is further fed on the conveyor 15 to the aforementioned spinning bobbin supplying station at which it receives a new spinning bobbin supplied thereto.

Figure 3:
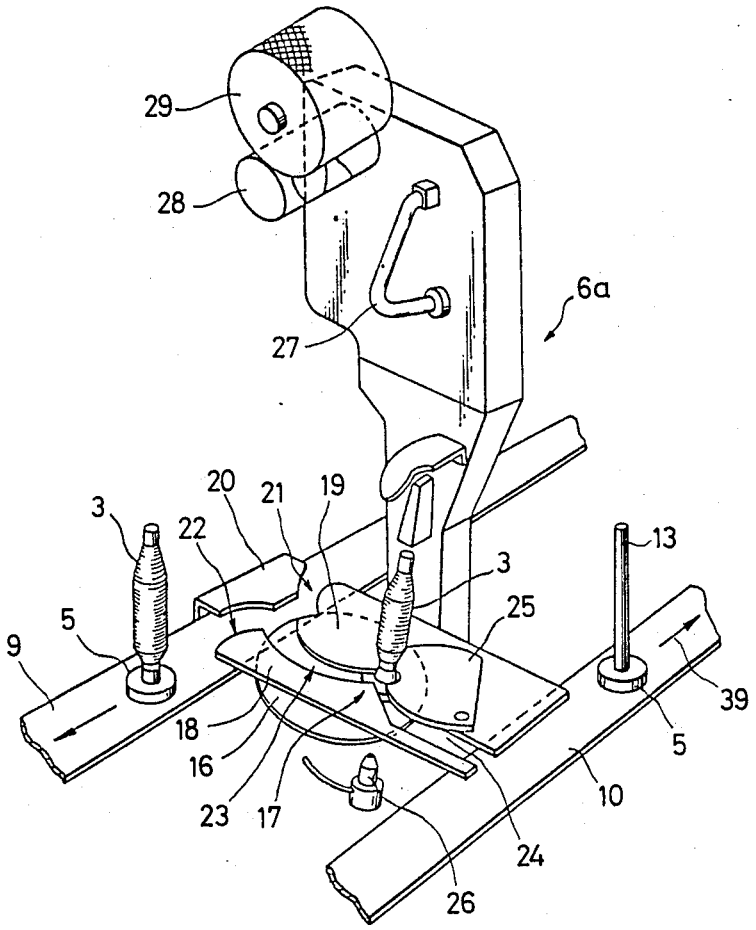
FIG. 3 is a perspective view showing an example of winding unit of a winder which can be applied to the system of FIG. 1.

FIG. 3 illustrates an example of winder which is applied to the system described above. In particular, a plurality of winding units *6a* are provided in juxtaposed relationship to constitute a winder W. The winding units *6a* are located between the spinning bobbin transporting path 9 and the empty bobbin transporting path 10. Each of the winding units *6a* includes a rotary disk 16 for feeding a spinning bobbin on the transporting path 9 to a rewinding position 17 and for discharging onto the transporting path 10 an empty bobbin from which a yarn has been unwound. A pair of guide plates 18 and 19 are disposed in a spaced relationship above the rotary disk 16 and cooperatively define a spinning bobbin stand-by guideway 23 and a bobbin discharging guideway 24 while the guide plate 19 cooperates with another guide plate 20 to define therebetween a spinning bobbin inlet port 21 and a surplus bobbin outlet port 22. A connecting position between the stand-by guideway 23 and the bobbin discharging guideway 24 presents the rewinding position 17. Reference numeral 25 denotes a lever for discharging an empty bobbin or a partial-bobbin.

A compressed air injection nozzle 26 is located below a carrier at the rewinding position 17 and is connected to a compressed air supply source not shown by way of a conduit. Compressed air injected from the nozzle 26 passes through an arcuate slit not shown which is formed in the rotary disk 16 and is then injected into a take-up tube of a bobbin through a spacing within a peg of a carrier 5 to thus blow up an end of a yarn suspended within the take-up tube from the top end of the take-up tube upwardly outside the take-up tube. The yarn end thus blown up is sucked in and held by a relay pipe 27 at a stand-by position above the spinning bobbin 3 at the rewinding position 17. The relay pipe 27 then pivots upwardly to introduce the yarn end into a knotter which splices a yarn end on a package side and another yarn end on a yarn feeding side to each other. After splicing of both yarn end, rewinding operation is resumed. Reference numeral 28 designates a traverse drum and 29 a winding package.

Figure 4:
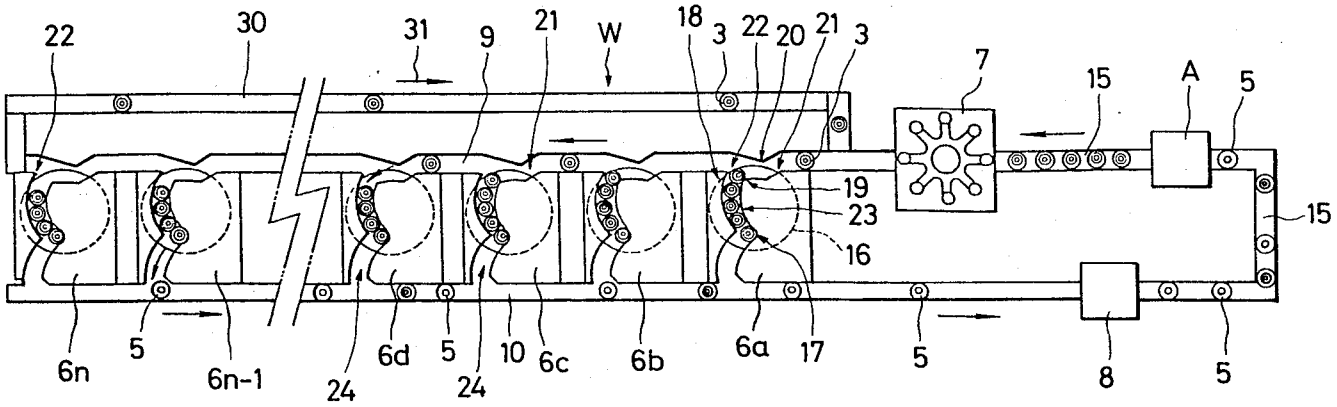
FIG. 4 is a plan view showing a bobbin transporting path of a winder.

FIG. 4 is a plan view showing a bobbin supplying system for supplying spinning bobbins to a winder in which a number of winding units such as those designated by 6*a* to 6*n* are provided in juxtaposed relationship.

In particular, a spinning bobbin which is fed on the transporting path 15 comes to the yarn end finding device 7 at which an end of a yarn for splicing is found and picked up. Then, the spinning bobbin is fed onto the transporting path 9 of the winder while it is held fitted on a carrier with a yarn end inserted in the take-up tube of the bobbin as described above. The carrier 5 of the spinning bobbin 3 which has been fed on the transporting path 9 is then abutted against the guide plates 18, 19 and 10 of the winding unit 6*a* and is thus transferred onto the rotary disk 16 so that it is admitted into the stand-by guideway 23 by way of the inlet port 21 and comes to the rewinding position 17. After succeeding spinning bobbins are admitted one after another into the stand-by guideway 23 and the stand-by guideway 23 is filled with a predetermined number of spinning bobbins, further succeeding spinning bobbins are not admitted into the stand-by guideway and hence will advance to a next winding unit 6*b* by way of the surplus bobbin outlet port 22.

In this way, the winding units are filled one after another with carriers having spinning bobbins fitted thereon, beginning with the winding unit 6*a* which is nearmost to the yarn end finding device 7 and ending the farthest winding unit 6*n*. If there appear empty rooms in any stand-by guideway 23, such empty rooms will be filled with bobbins, beginning with one which is nearest to the yarn end finding device 7. Spinning bobbins which have not been admitted by any of the winding units 6*a* to 6*n* are introduced, after they have come out of the surplus bobbin outlet port 22 of the last winding unit 6*n*, into a circulating path 30 and is then fed in a direction of an arrow mark 31 so that it is applied to the spinning bobbin transporting path 9 again.

Figure 5:
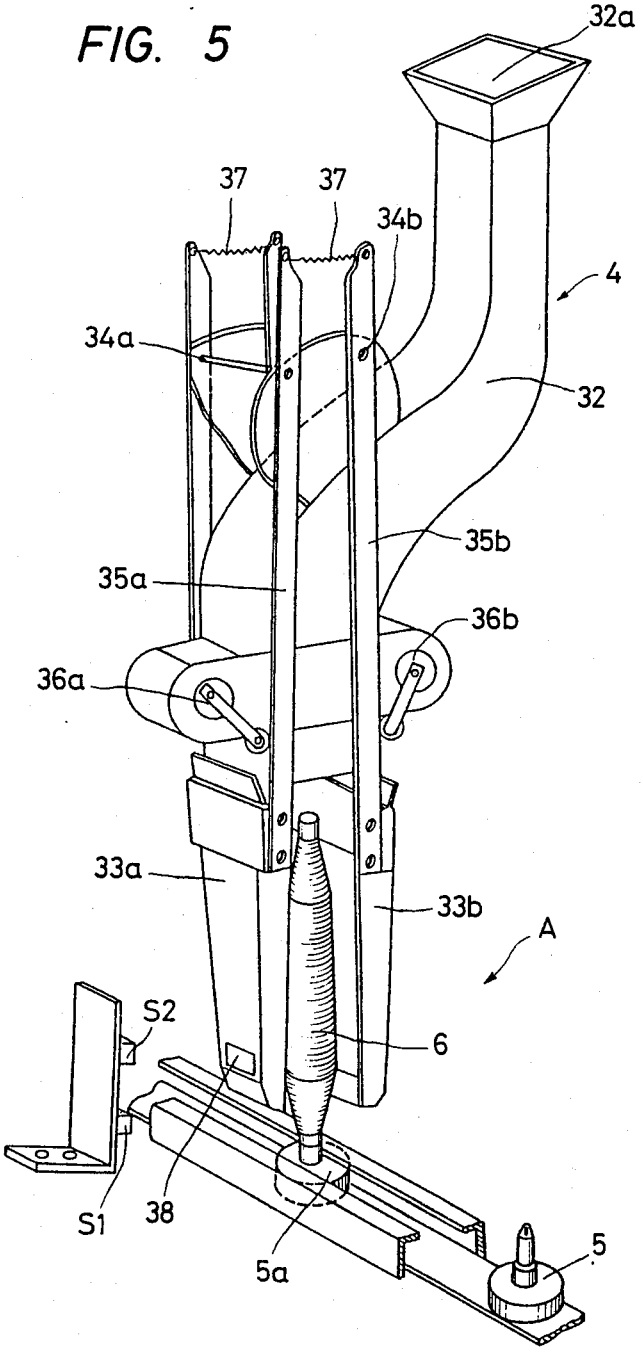
FIG. 5 is a perspective view showing an example of bobbin supplying device in a spinning bobbin supplying station.

FIG. 5 illustrates an example of the spinning bobbin supplying station. In particular, the spinning bobbin supplying station A includes a sensor S1 for detecting arrival of an empty carrier, a chute 32 for receiving a spinning bobbin from a transport band of the fine spinning frame, movable guides 33*a* and 33*b* located contiguously to the chute 32 for guiding a spinning bobbin to a position of a peg of a carrier, and so on. The movable guides 33*a* and 33*b* are mounted on levers 35*a* and 35*b* which are in turn mounted for rocking motion around pivot shafts 34*a* and 34*b* such that they are opened and closed in directions perpendicular to a direction of transportation of carriers by operation of rotary solenoids 36*a* and 36*b* and by means of a pair of springs 37, respectively.

In particular, the guides 33*a* and 33*b* are normally in their open positions to wait for arrival of a carrier, and when a spinning bobbin is to be supplied and fitted onto the empty carrier, they are closed to guide the spinning bobbin to the peg position at the center of the carrier. After the spinning bobbin has been fitted, the guides 33*a* and 33*b* are opened again to release the carrier on which the spinning bobbin is fitted so that the carrier may be transported to the winder.

The sensor S1 is provided for detecting arrival of a carrier while another sensor S2 is provided for detecting whether there is an empty bobbin or a partial-bobbin on a tray. The sensor S1 is provided for the peg position of a carrier while the sensor S2 is provided at a position for illuminating a light beam on the center line of the carrier above the peg. Reference numeral 38 denotes a light passing hole.

Now, description will be given of bobbin transporting operations in the system in which such devices or components as described above are arranged.

An empty bobbin 13 which has been taken into the winding position 17 of the winding unit 6*a* while held in the condition of FIG. 3, that is, while held fitted on a carrier 5 and has then rewound thereat is then discharged from the winding position 17 onto the empty bobbin transporting conveyor 10 while it is held fitted on the carrier 5. The empty bobbin 13 is then transported on the conveyor 10 in a direction of an arrow mark 39 to the bobbin extracting device 8 which is shown in FIG. 4.

At the extracting device 8, the empty bobbin 13 is pulled manually and automatically off its carrier 5 and is fed back to the fine spinning frame 1 by the empty bobbin transporting path 12 shown in FIG. 1.

In the meantime, the empty carrier 5 which has passed by the extracting device 8 is then fed on the transporting path 15 shown in FIG. 4 and comes to the spinning bobbin supplying station A. At the station A, the carrier 5 is brought to the spinning bobbin supplying position 5*a* as shown in FIG. 5 and is stopped thereat by means of positioning stoppers. Then, if absence of a bobbin on the carrier is found by the receipt of signals from both the carrier detecting sensor S1 and the bobbin detecting sensor S2, then a signal is produced for feeding the transport band 2 of the fine spinning frame of FIG. 1 by one pitch. Simultaneously, the solenoids 36*a* and 36*b* of FIG. 5 are energized to close the guides 33*a* and 33*b* in order to wait for supply of a spinning bobbin. After the transport band 2 of the fine spinning frame has been fed by one pitch, a spinning bobbin 3*a* at an end of an inclined portion of the band 2 is released and thrown into the chute 32. In particular, the spinning bobbin thrown in through an opening 32*a* of the chute 32 of FIG. 5 drops along the chute 32 and then between the guides 33*a* and 33*b* and is fitted erectly onto empty carrier at the stand-by position below. It is to be noted that, upon throwing in of a spinning bobbin, the dropping direction of the spinning bobbin is controlled. In particular, a spinning bobbin has a top portion and a bottom portion and is fitted on a carrier with its bottom portion down. Accordingly, an orientation controlling device may be provided which includes a guide for guiding, when a spinning bobbin drops, the spinning bobbin thrown into the chute to temporarily bring the same into a horizontal position, and a pin secured within the chute for engaging with the top portion of the spinning bobbin in the horizontal position, whereby the spinning bobbin drops within the chute 32 with the bottom portion thereof inclined downwardly with the top portion thereof being held from dropping by the pin.

After the spinning bobbin 3 has been fitted on an empty carrier in this way, the bobbin detecting sensor S2 becomes off to find fitting of a spinning bobbin, and as a result, the guides 33*a* and 33*b* are opened and the stopper for the carrier 5*a* is released. As a result, the spinning bobbin 3 is transported and supplied on the transporting path to the yarn end finding device and then to the winder.

In the winder, the carrier 5 on which the spinning bobbin is fitted is fed along the supplying path 9 and is automatically supplied to one 6*d* of winding units which has an empty room in its stand-by guideway, as illustrated in FIG. 4.

It is to be noted that a partial-bobbin which has been discharged from the winder circulates along the transporting paths while it is held fitted on a carrier. Thus, the bobbin passes by the bobbin extracting device 8 and the spinning bobbin supplying station A and comes to the yarn end finding device 7 at which an end of a yarn is found and picked up again whereafter it is supplied to the winder again.

Figure 6:
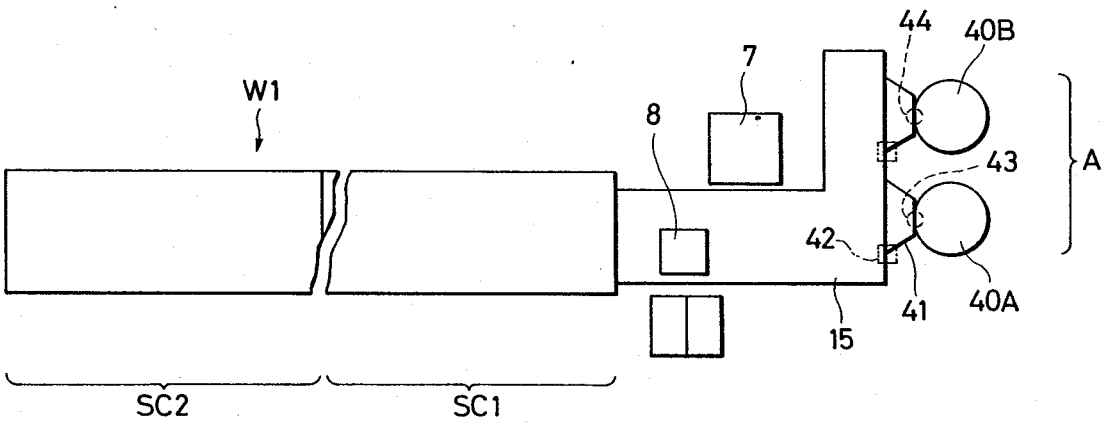
FIG. 6 is a diagrammatic representation showing a second embodiment of a system of the invention.

FIG. 6 illustrates another embodiment of a spinning bobbin supplying system wherein, by means of spinning bobbin feeders 40A and 40B in which spinning bobbins are contained at random, bobbins are fed to a station A for supplying a spinning bobbin to an empty carrier.

It is to be noted that the embodiment of FIG. 6 illustrates an example in which a plurality of kinds of yarn are rewound on a single winder W1. Thus, yarns of types A and B are rewound at winding sections SC1 and SC2, respectively, and spinning bobbins for the individual sections are supplied onto empty carriers by the spinning bobbin feeders 40A and 40B. Bobbin transporting carriers are differentiated for the individual sections, and such carriers may be used, for example, which can be identified by color or by presence and absence of an annular groove around the carrier.

Accordingly, when a carrier which has been discharged, for example, from the winding section SC1 and on which an empty bobbin is fitted comes to a position of a bobbin extracting device 8, the empty bobbin or a small amount of yarn bobbin is pulled off the carrier. The thus emptied carrier is then fed on a transporting path 15 until it comes to the supplying station A. Just before a branch path 41, a carrier selecting device 42 is provided which includes, for example, a mark sensor, a selection gage provided at a position corresponding to the identification groove, or the like. Thus, the empty carrier is taken into the branch path 41 by the carrier selection device 42, and then when it comes to a spinning bobbin supplying position 43, it is confirmed by AND signals from sensors S1 and S2 similar to those of FIG. 5 while a spinning bobbin is released from the bobbin feeder 40A. The spinning bobbin thus released is supplied and fitted onto the carrier by way of guide chutes 33*a* and 33*b* shown in FIG. 5.

Similarly, an empty carrier for the winding section SC2 is supplied with a spinning bobbin for the section SC2 at a supplying station 44. Thus, both spinning bobbins pass a common yarn end finding device 7 and are supplied to the respective winding sections of the winder W1.

As apparent from the foregoing description, according to the present invention, only if, after an empty bobbin discharged from a winder after completion of winding operation has been fitted onto and then pulled off a carrier, the carrier arrives at a spinning bobbin supplying position intermediate a transporting path, a spinning bobbin is supplied to the empty carrier. In other words, the carrier serves as a bobbin transporting medium and also as a spinning bobbin demanding signalling member, and accordingly, when a carrier circulating within a winder area comes to the spinning bobbin supplying position, the carrier provides a spinning bobbin demanding media so that a spinning bobbin is released from a spinning bobbin supplying device and is supplied onto the carrier. The carrier on which the bobbin is fitted is transported and supplied again to the winder. Accordingly, no electric wiring for transmitting a bobbin demanding signal is necessary between the winder itself and the spinning bobbin supplying device, and there is no necessity of controlling the timing for supply. Thus, demanding for a spinning bobbin on the winder side can be detected by arrival of an empty carrier at the spinning bobbin supplying position. In other words, the winder and the spinning bobbin supplying device is held in a 1:1 corresponding relationship by way of a carrier, and hence spinning bobbins are not supplied too much or in short to the winder. Accordingly, very stabilized winding operation can be performed without the necessity of a complicated controlling device.

What is claimed is:

1. A bobbin supplying system comprising:

a winder;

a spinning bobbin supplying station;

a plurality of carrier members configured to support said bobbins;

a carrier transporting path provided between said winder and said spinning bobbin supplying station for guiding and conveying said carrier members between said winder and said spinning bobbin supplying station;

a first sensor for generating a first signal indicative of the presence of a carrier member ato a predetermined location on said carrier transporting path;

a second sensor for generating a second signal indicative of the absence of a bobbin on said carrier member located at said predetermined location;

a delivery means responsive to said first and second signals for delivering a spinning bobbin from said spinning bobbin supplying station to said carrier member lcoated at said predetermined location.

2. A bobbin supplying system as claimed in claim 1, wherein said spinning bobbin supplying station further comprises: a stopper for said carrier member at said predetermined location on said carrier transporting path, a chute for directing said spinning bobbin from said spinning bobbin supply station toward said carrier member, and movable guides for guiding said spinning bobbin from said chute to said carrier member.

3. A bobbin supplying system as claimed in claim 2, wherein said movable guides are responsive to said first signal from said first sensor and to said second signal from said second sensor.

4. A bobbin supplying system as claimed in claim 2 further comprising: a spinning bobbin supply device for supplying said spinning bobbin supply station with a spinning bobbin in response to said first signal and said second signal.

5. A bobbin supplying system comprising:

a winder;

a bobbin supply station;

a transportation path between said winder and said bobbin supply station upon which said bobbins are transported between said winder and said bobbin supply station;

a carrier member configured to receive one of said bobbins disposed on said transportation path;

a carrier detecting means for generating a first signal indicative of the presence of said carrier member at said bobbin supply station;

a bobbin detecting means for generating a second signal indicative of the absence of a bobbin on said detected carrier member; and bobbin releasing means for releasing a bobbin from said bobbin supply station onto said carrier member in response to said first and second signals.

6. A bobbin supply system according to claim 5, further comprising:

a spinning frame; and bobbin discharge means in communication with said carrier detecting means and said bobbin detecting means for releasing a bobbin from said spinning frame to said bobbin supply station upon receipt of said first and second signals by said bobbin discharge means.

7. A bobbin supply system according to claim 5, wherein said bobbin supply station further comprises:

movable releasing means for controllably releasing a bobbin from said bobbin supply station onto said carrier member.

8. A bobbin supply system according to claim 7, wherein said movable releasing means comprises:

at least two pivot shafts;

a lever pivotally mounted on each of said pivot shafts; and solenoid means responsive to said first and second signals for causing said levers to pivot towards one another.

9. A bobbin supply system according to claim 6, further comprising:

bobbin extracting means located adjacent said transportation path for removing an empty bobbin from said carrier member.

10. An improved bobbin supply system having a plurality of bobbin carrier members which are transferred on a conveyor path between a winder and a spinning bobbin supply station, the improvement comprising:

a first sensor for generating a first signal indicative of the presence of a carrier member at a predetermined location on said conveyor path;

a second sensor for generating a second signal indicative of the absence of a bobbin on said carrier member located at said predetermined location.

a delivery means responsive to said first and second signals for delivering a spinning bobbin from said spinning bobbin supply station to said carrier member located at said predetermined location.

* * * * *